United States Patent [19]

Larson et al.

[11] 3,954,318

[45] May 4, 1976

[54] ELECTRICAL CONNECTOR

[75] Inventors: Donald Herbert Larson, Arlington Heights; Joseph E. Josephs, Chicago, both of Ill.

[73] Assignee: Warwick Electronics Inc., Chicago, Ill.

[22] Filed: Jan. 30, 1975

[21] Appl. No.: 545,618

[52] U.S. Cl. ..... 339/64 R; 339/66 R; 339/126 R; 339/184 R

[51] Int. Cl.[2] ..... H01R 13/62

[58] Field of Search ..... 339/64–66, 339/125, 126, 128, 184

[56] References Cited

UNITED STATES PATENTS

| | | | |
|---|---|---|---|
| 1,157,026 | 10/1915 | Menschenmoser | 339/64 R |
| 2,938,188 | 5/1960 | Lazzery | 339/128 |
| 3,184,702 | 5/1965 | Tenniswood | 339/66 R |
| 3,448,429 | 6/1969 | Szeremy et al. | 339/128 |
| 3,560,908 | 2/1971 | Dell et al. | 339/128 |

*Primary Examiner*—Joseph H. McGlynn
*Attorney, Agent, or Firm*—Wegner, Stellman, McCord, Wiles & Wood

[57] ABSTRACT

An electrical connector for use in preventing electrical operation of an appliance by its normal power cord when an access panel to the interior of the appliance is removed. The connector includes electrically connectable male and female elements, one of which is mounted in the appliance housing and the other of which is mounted to the closure panel. A guide structure is associated with the connector element mounted in the appliance for guiding the other element into accurately aligned relationship therewith prior to engagement between the elements, thereby providing effectively improved and facilitated electrical connection of the appliance to a power source. The guide structure further cooperates with cooperative securing elements provided for securing the closure panel to the appliance housing to effect automatic alignment therebetween when the connector elements are aligned.

16 Claims, 5 Drawing Figures

ELECTRICAL CONNECTOR

BACKGROUND OF THE INVENTION

1. Field of the Invention

This invention relates to electrical connectors and in particular to safety-type electrical connectors for preventing operation of an electrical appliance under certain conditions.

2. Description of the Prior Art

In certain electrical appliances, such as television receivers, the electrical components are disposed fully within an outer housing. An access opening is provided within the housing which is selectively closed by a closure panel removably secured to the housing to extend across the access opening. To prevent an unauthorized person from having access to the electrical apparatus when the closure panel is removed, the electrical power means is associated with the closure panel in such a way that removal of the panel effectively breaks the power supply. The conventional serviceman may energize the appliance with the closure panel removed by utilizing a special connector cord, whereas the ordinary owner or user of the apparatus, not having such a special connector cord, is normally protected from injury as by electrical shock, etc., by the prevention of application of electrical power to the appliance as an incident of the closure panel removal.

In a television receiver apparatus, certain portions of the apparatus are at relatively high voltage so that, for safety reasons, it is very important that the power supply be so interrupted when the closure panel is removed. A conventional arrangement in such television receivers has been to mount a female connector in such a way as to extend through the closure panel, and in such a position as to be electrically fitted onto a male connector carried by the rear of the receiver chassis within the cabinet when the closure panel is positioned across the housing opening. It has been found, however, that inasmuch as the female connector plug is disposed normally in such a manner as to make it difficult to ascertain its precise positioning relative to the male connector as the closure panel is brought to the opening-closing position, the plug is often engaged with the male connector pins laterally of the female sockets so that damage to the pins and plug results. Illustratively, the pins may be bent or deflected and the soft plug material deformed by such engagement.

Another problem in the conventional electrical appliance utilizing such a safety power supply connection means is the requirement that the means for securing the closure panel to the housing be accurately related to the position of the connector element carried in the appliance. Thus, conventionally, the closure panel is provided with a plurality of holes preselected to be aligned with securing portions of the housing when the connector element carried by the closure panel is aligned with the connector element of the apparatus. As the mounting of the connector element to the closure panel is substantially fixed, it is necessary that low tolerances be utilized in providing such accurate relationship during manufacture.

A number of prior art structures are disclosed in the prior art relating to the safety disconnect systems of such power supplies and apparatus for use therein. Thus, as shown in J. W. Myers U.S. Pat. No. 1,775,654, a safety cabinet is provided wherein the electrical connector is exposed through an opening in a hingedly mounted cover plate when the cover plate is disposed in a closed position across an access opening to the cabinet.

In the U.S. Pat. No. 1,645,261 of E. E. Sutherland, a terminal support is shown wherein male pins are mounted in a tubular guide which is outwardly flared at its distal end and which is exposed for observation by the user so as to permit facilitated connection of a female plug thereto.

H. H. Schulz, in U.S. Pat. No. 2,672,506, shows a mounting for television receiver sets wherein the male and female elements are provided in a long mounting tube which is suitably keyed so as to provide preselected alignment of the pin and socket elements thereof.

In A. H. Junkins U.S. Pat. No. 2,752,413, an electrical interlock is provided for use in conjunction with high voltage power supplies for television receivers. As shown therein, the female plug is connected to the male connector element when the rear cowling is secured to the housing. The Junkins patent teaches male pins projecting outwardly sufficiently to be engaged by the female plug laterally of the female plug sockets whenever the cowling is brought forwardly in other than accurately aligned original disposition and, thus, presents the serious problem of potential damage to the pins and plug discussed above.

W. R. Francis discloses, in U.S. Pat. No. 2,869,094, an adjustable panel mounting for a cord connector wherein a plug for a television receiver is adjustably mounted in an opening in the closure panel.

In U.S. Pat. No. 2,874,205 of C. F. Race, an electrical connector is shown for interlocking power connections in a portable radio or the like, which is similar to Junkins in teaching the projection of the male pins sufficiently outwardly to be engaged and damaged by inadvertent abutment of the female plug therewith laterally of the female plug sockets.

H. A. Pappano et al show, in their U.S. Pat. No. 3,052,865, a power cord adaptor which is generally similar to that of Francis in disclosing the use of a female plug adjustably mounted to a removable cover of an electrical apparatus.

W. R. Hicks, in U.S. Pat. No. 3.025,490, shows an electrical plug receptacle structure which is generally similar to that of Sutherland in providing a male pin connector which is exposed through the housing for electrical connection of a conventional female plug thereto.

H.J. Tenniswood, in U.S. Pat. No. 3,184,702, shows electrical connector apparatus wherein a frustopyramidal mounting means is provided for the male and female electrical connector means with the pyramidal configuration permitting lateral displacement of the plug-in socket prior to the interengagement therebetween while effecting an aligned relationship only when the pins and female elements are fully engaged.

SUMMARY OF THE INVENTION

The present invention comprehends an improved electrical connector for effecting "blind" electrical power connection in an electrical appliance, such as a television receiver. The invention comprehends providing an electrical connector mounted in the housing in association with a guide means which causes accurately aligned association of a complementary electrical connector carried by the closure panel of the housing. The guide means causes an accurate alignment of the panel-carried connector elements with the element carried in the housing prior to engagement between the connector elements to effectively positively avoid damage thereto as by inadvertent lateral displacement of one relative to the other during such connection.

The connector element carried by the closure panel may be laterally movably mounted thereto to accommodate relatively high tolerances in the mounting of the element to the closure panel. Further, the closure panel may be provided with prelocated means for use in securing the closure panel to the housing. The movable mounting of the connector element to the closure panel permits facilitated connection thereof to corresponding securing means on the housing notwithstanding relatively high tolerances in the location of the securing means relative to the electrical connector means.

Thus, by use of the present invention, the need for attempting to align the electrical connectors by reference to the securing means openings of the conventional closure panel and the corresponding openings in the housing is obviated and, antithetically, the alignment of the securing means may be effected subsequent to the facilitated alignment of the electrical connector means provided by the improved guide structure.

The guide structure may further define, in the present invention, a shield extending about the connector element carried in the apparatus. The guide means may define a fire wall means for preventing spread of a flame away from the connector means. The guide means may define a heat sink extending about the connector means for absorbing thermal energy therefrom.

The male connector element includes pins which are recessed suitably to prevent engagement by the female connector element until after the guide means has effected accurate alignment therebetween, thereby effectively avoiding damage to the pin and socket means of the connector elements.

The guide means may comprise a pair of brackets fixedly secured in the apparatus. In the illustrated embodiment, the guide means define rearwardly extending flanges circumscribing an opening adapted to receive the closure panel connector element and effect the desired guiding thereof into aligned association with the other connector element.

The male connector element may define a pair of keyed pins for assuring proper polarity of the electrical connection.

The invention comprehends providing the male connector element on the receiver in the housing with the male connector element effectively recessed within the guide means.

The guide means may comprise two interconnected brackets and means for accurately mounting the brackets to each other and in relationship with the enclosed connector element.

Thus, the invention comprehends an improved electrical connector which is extremely simple and economical of construction while yet providing the highly desirable advantages discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5:
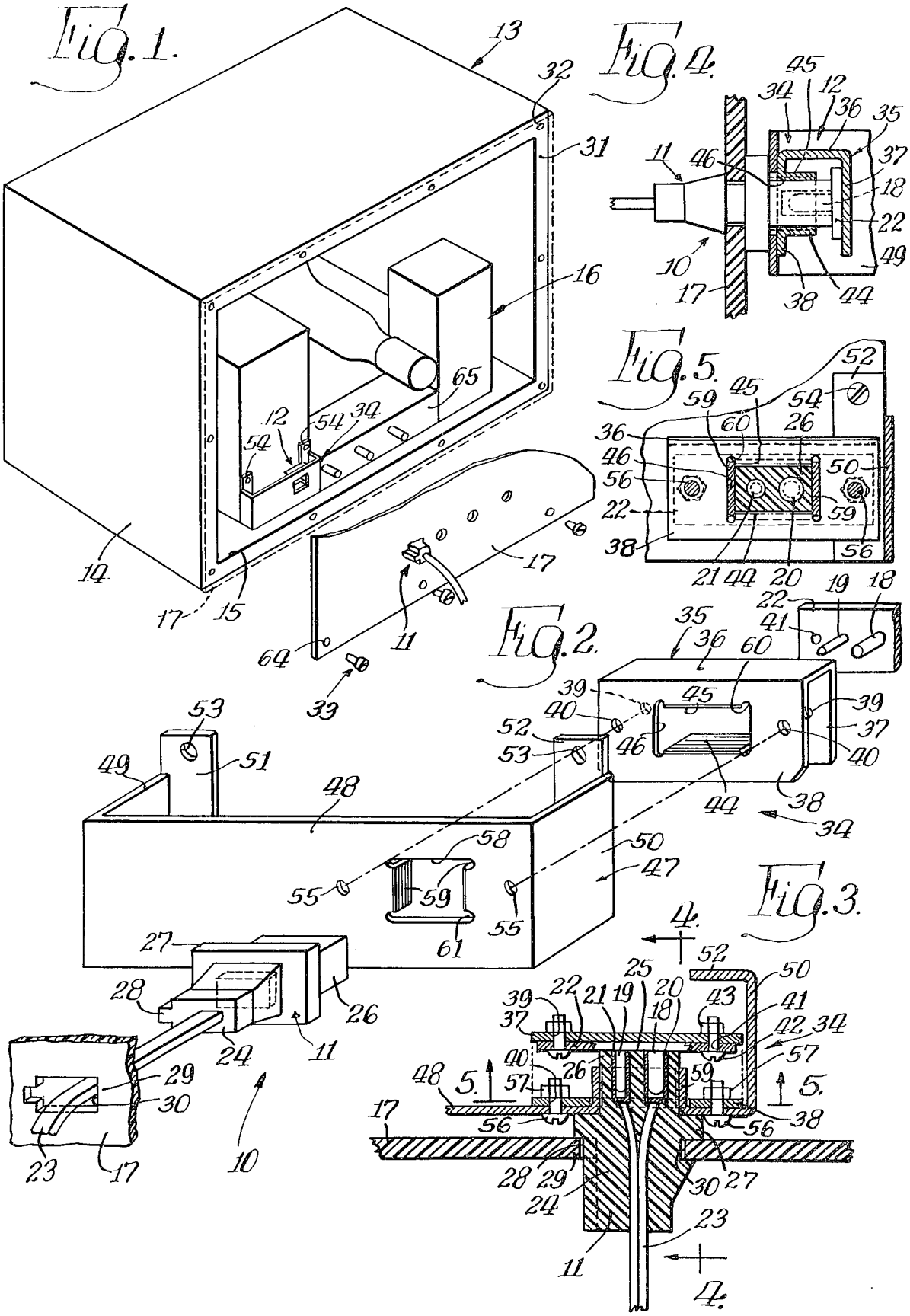
FIG. 1 is a rear perspective view of a television receiver provided with electrical connector means embodying the invention and with a portion of the closure panel broken away to facilitate illustration.
FIG. 2 is an exploded broken view illustrating the assembly of the electrical connector.
FIG. 3 is a fragmentary horizontal section of the structure with the electrical connector elements in electrically connected association.
FIG. 4 is a vertical section taken substantially along the line 4—4 of FIG. 3.
FIG. 5 is a vertical section taken substantially along the line 5—5 of FIG. 3.

In the exemplary embodiment of the invention as disclosed in the drawing, an electrical connector generally designated 10 is shown to comprise a first electrical connector element generally designated 11 and a cooperating second electrical connector element generally designated 12. Connector 10 is adapted for use in providing a safety interlocked power connection for preventing injury to a person gaining access to electrical equipment powered through the electrical connector. More specifically, as shown in FIG. 1, the connector may be utilized in an electrical appliance, such as a television receiver generally designated 13, having an outer housing, or cabinet, 14 provided with an access opening 15 exposing the electrical components 16 of the receiver when a closure panel 17 is removed. In the illustrated embodiment, electrical connector element 11 comprises a female plug and electrical connector element 12 comprises a male connector defined by a pair of terminal pins 18 and 19 to be received within female sockets 20 and 21 of the female plug, it being obvious to those skilled in the art that a reverse arrangement of the male and female elements may be utilized within the scope of the invention. Thus, while the invention is claimed pursuant to the illustrated arrangement of the female connector element being mounted on the closure panel and the male connector element being mounted to the receiver apparatus, the claims are to be understood as comprehending a reverse arrangement equally as well.

As shown, in the illustrated embodiment, male connector element 12 may be carried on a conventional terminal board 22 for providing electrical power to the receiver apparatus 16 from a power cord 23 connected to the sockets 20 and 21 of plug 11 and mounted in an insulating body 24 thereof to be exposed through an inner surface 25 of an inner portion 26. The plug further includes an enlarged mid-portion 27 defining a slot 28 receiving the edge portion 29 defining an opening 30 in the closure panel 17. The opening 30 is slightly larger than the transverse dimensions of the plug portion defined by slot 28 so as to permit limited lateral adjustment of the plug on the closure panel.

Cabinet 14 may include a peripheral inturned flange portion 31 provided with a plurality of female securing means 32 comprising openings in the flange portion adapted for threaded engagement by a plurality of screws 33 passed through suitable corresponding openings 64 in the closure panel for removably securing the closure panel across the access opening 15 and thereby precluding access to the interior of the cabinet.

The mounting of the connector elements 11 and 12 is preselected so that when the closure panel is so secured across the access opening 15, an electrical connection between the connector elements is effected, as shown in FIGS. 3 and 4 of the drawing. Reversely, when the closure panel is removed to provide access to the electrical apparatus 16, the connection between connector elements 11 and 12 must be broken whereby electric power to the apparatus 16 is interrupted through the power supply connector 10.

As indicated briefly above, the present invention comprehends an improved construction of connector 10 which effectively precludes damage to and/or deformation of the male connector pins and female plug by an inadvertent engagement of the pins with the female connector surface 25 laterally of the sockets 20 and 21 which may occur in conventional prior art structures of this type. More specifically, inasmuch as the closure panel is relatively large in transverse dimension, it is difficult to precisely locate the connector element carried thereby as it is brought into engagement with the electrical connector carried by the electrical apparatus and, thus, frequently the male pins and plug are deformed inadvertently by the disaligned abutment and subsequent repositioning of the connector element carried by the closure panel in an attempt to find the laterally adjusted aligned position necessary to provide the desired electrical connection.

The present invention effectively eliminates this undesirable potential connector deformation condition by means of a guide structure generally designated 34 associated with the connector element 12 in such a way as to assure the alignment of the connector 11 therewith prior to engagement between the connector elements. In addition to the guiding action, guide structure 34 synergistically provides safety features such as flame enclosure and heat sink functioning for further improved construction of the apparatus.

As best seen in FIG. 2, guide structure 34 includes a first U-shaped bracket 35 having an upper bight portion 36, a rear downturned leg 37 and a front downturned leg 38. Legs 37 and 38 are provided with pairs of openings 39 and 40. Terminal board 22 is provided with a pair of openings 41 aligned with rear leg openings 39 for receiving suitable bolts 42 cooperating with nuts 43 for securing rear leg 37 to the terminal board. As shown in FIG. 4, rear leg 37 is disposed rearwardly of the terminal board 22 with bight portion 36 of bracket 35 extending over the top of the terminal board.

As further illustrated in FIG. 4, bracket leg 38 is provided with a lower rear turned flange 44 and an upper rear turned flange 45 defining the lower and top front edges of an opening 46 for receiving the inner portion 26 of plug 11.

Guide structure 34 further includes a second bracket 47 having a front bight portion 48, a left leg 49, and a right leg 50 provided with distal mounting flanges 51 and 52, respectively. The mounting flanges may be provided with suitable holes 53 for receiving screws 54 to secure the bracket 47 to apparatus 16. Bight portion 48 is provided with suitable holes 55 arranged to align with holes 40 of first bracket front leg 38 for cooperation with suitable bolts 56 and nuts 57 for mounting bracket 35 to bracket 47.

Bight portion 48 of bracket 47 further defines an opening 58 adapted to be aligned with opening 46 of bracket 35 when bracket 35 is so mounted to bracket 47. Opening 58 is further defined by rearwardly turned flanges 59 at the left and right sides of the opening adapted to extend rearwardly through opening 46 and cooperate with flanges 44 and 45 of bracket 35 to define an enclosing guide for connector portion 26 of electrical connector 11, as best seen in FIG. 5. It should be noted that bracket 47 could be formed as an integral portion of the rear flange of the chassis pan 65, thereby eliminating the need for holes 53 and fasteners 54.

As shown in FIG. 3, enlarged mid-portion 27 of plug 11 may abut the front surface of second bracket bight portion 48 when the plug 11 is electrically connected to the male connector 12. As the flanges 44, 45 and 59 are rearwardly turned from the portions of the brackets defining the openings 46 and 58, respectively, they define a rounded entrance to the space between the flanges facilitating guiding of the plug portion 26 to therebetween and assuring positive alignment of the male connector pins and female connector sockets before engagement between the respective electrical connector elements thereby effectively preventing damage to the connector elements as may occur in the prior art devices as discussed above.

As the opening 30 in closure panel 17 permits limited lateral adjustment of the plug 11 on the closure panel, facilitated manufacture of the appliance is permitted by minimizing the requirement for high tolerances in the location of the flange openings 32 relative to the mounting of the connector element 12 on the apparatus 16. As indicated above, the guide structure 34 further provides safety means in the appliance. Thus, as best seen in FIGS. 3 and 4, brackets 35 and 47 cooperatively define a fire barrier enclosing the connected electrical connector elements and a heat sink for absorbing thermal energy at the electrical connection.

As shown in FIG. 3, pins 18 and 19 are of different size to provide voltage polarity keying, thereby assuring that the grounded connector lead is suitably connected to the ground of the appliance.

To assure proper relationship of flanges 59 to flanges 44 and 45, the respective openings 46 and 58 may be provided with relieved corner portions 60 and 61, respectively, adapted to accommodate the edges of the complementary flanges.

Further, as shown in FIGS. 1, 3 and 4, the terminal pins 18 and 19 are effectively recessed behind the front bight portion 48 of bracket 47, thereby preventing damage to the pins prior to the installation of apparatus 16 in the cabinet or disposition of the closure panel 17 across the opening 15 as during manufacturing operations.

Flanges 44, 45 and 59 further cooperate with the aligned openings 55 and 40 of the two brackets and the openings 39 and 41 of the first bracket and terminal board 22 to accurately dispose guide structure 34 relative to the terminal pins 18 and 19 for preventing damage to the pins and plug during connection between the connector elements as discussed above.

The foregoing disclosure of specific embodiments is illustrative of the broad inventive concepts comprehended by the invention.

Having described the invention, the embodiments of the invention in which an exclusive property or priviledge is claimed are defined as follows:

1. In an electrical appliance having a housing provided with an access opening, and a closure panel for closing said opening, the improvement comprising: a male electrical connector mounted in said housing and having pins extending outwardly to adjacent said opening; a female connector carried by said panel to have limited lateral movement relative to said panel and being disposed to have electrically connected mating engagement with said male connector when said closure panel is disposed to close said opening, said female connector having outer insulating means; and guide means mounted in said housing in accurately aligned fixed relationship to said male connector for engagement by the female connector insulating means to guide said female connector into accurate alignment with said male connector prior to engagement of said pins by said female connector.

2. The electrical appliance structure of claim 1 wherein said guide means comprises a bracket structure defining a guide portion and a mounting portion, and means for securing said mounting portion in fixed relationship to said male connector with said guide portion in accurate surrounding relationship to said male connector pins.

3. The electrical appliance structure of claim 1 wherein said guide means comprises a bracket structure defining a guide portion and a mounting portion, and means for securing said mounting portion in fixed relationship to said male connector with said guide portion in accurate preselected relationship to said male connector pins, said guide portion comprising flange means carried by said bracket.

4. The electrical appliance structure of claim 1 wherein said guide means comprises a bracket structure defining a guide portion and a mounting portion, and means for securing said mounting portion in fixed relationship to said male connector with said guide portion in accurate preselected relationship to said male connector pins, said bracket structure comprising a first bracket extending about said male connector pins and defining a front opening aligned with said male connector, a second bracket having a front opening, and means for accurately aligning said second bracket opening with said first bracket opening.

5. The electrical appliance structure of claim 1 wherein said guide means comprises a bracket structure defining a guide portion and a mounting portion, and means for securing said mounting portion in fixed relationship to said male connector with said guide portion in accurate preselected relationship to said male connector pins, said bracket structure comprising a first bracket extending about said male connector pins and defining a front opening aligned with said male connector, a second bracket having a front opening, and means for accurately aligning said second bracket opening with said first bracket opening, said aligning means further defining at least a portion of said means for guiding the female connector into alignment with said male connector pins.

6. The electrical appliance structure of claim 1 wherein said guide means defines a shield extending about said male connector pins.

7. The electrical appliance structure of claim 1 wherein said guide means defines fire wall means for preventing spread of a flame away from said male connector.

8. The electrical appliance structure of claim 1 wherein said guide means defines a heat sink extending about said male connector absorbing thermal energy from said connectors.

9. The electrical appliance structure of claim 1 wherein said guide means comprises a bracket structure defining a guide portion and a mounting portion, and means for securing said mounting portion in fixed relationship to said male connector with said guide portion in accurate preselected relationship to said male connector pins, said bracket defining a front wall disposed forwardly of said male connector pins.

10. The electrical appliance structure of claim 1 wherein said female connector is movably carried by said closure panel for adjustable positioning thereof on said closure panel as an incident of the guiding of the female connector by said guide means.

11. The electrical appliance structure of claim 1 wherein said female connector is laterally movably carried on said closure panel.

12. In an electrical appliance having a housing provided with an access opening and securing means spaced laterally of the opening, and a closure panel for closing said opening having means cooperating with said housing securing means for removably securing said closure panel to said housing across said opening, the improvement comprising: a male electrical connector mounted in said housing adjacent said opening; a female connector carried by said panel to have limited lateral movement relative to said panel and being disposed to have electrically connected mating engagement with said male connector when said closure panel is disposed across said opening, said female connector having outer insulating means; and guide means mounted in said housing in accurately aligned fixed spaced relationship to said male connector for engagement by the female connector insulating means to guide said female connector into accurate alignment with said male connector prior to engagement with said male connector and concurrently guiding said closure panel means into aligned association with said housing securing means for faciliated securing of the closure means to said housing, said limited lateral movement of the female connector relative to the closure panel permitting limited adjustment of said closure panel means into accurate alignment with said housing securing means.

13. The electrical appliance structure of claim 12 wherein said securing means on said housing comprises female means and said closure panel means comprises openings in said closure panel receiving male threaded means to be threaded to said female means to secure the closure panel to the housing.

14. The electrical appliance structure of claim 12 wherein said appliance comprises a television receiver, said housing comprises the outer cabinet of the receiver having a rear portion defining said opening, and said closure panel comprises a panel extending fully across said opening to prevent access to the interior of the housing wherein said female connector is electrically connected to said male connector.

15. The electrical appliance structure of claim 12 wherein said male connector defines a pair of keyed pins.

16. The electrical appliance structure of claim 12 wherein said appliance comprises a television receiver, said housing comprises the outer cabinet of the receiver having a rear portion defining said opening, said female connector comprises an electrical plug provided with an electrical cord for providing electrical power to the receiver, and said closure panel comprises a panel extending fully across said opening to prevent access to the interior of the housing when said female connector is electrically connected to said male connector.

* * * * *